US006435307B2

(12) United States Patent
Selby

(10) Patent No.: US 6,435,307 B2
(45) **Date of Patent: *Aug. 20, 2002**

(54) PRECISE REPLACEMENT OF LIQUIDS AND COMPONENTS IN A LIQUID MIXTURE

(76) Inventor: Theodore W. Selby, 4402 Arbor Dr., Midland, MI (US) 48640

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/349,660

(22) Filed: Jul. 8, 1999

Related U.S. Application Data

(60) Provisional application No. 60/092,127, filed on Jul. 9, 1998, and provisional application No. 60/132,087, filed on Apr. 30, 1999.

(51) Int. Cl.[7] ..... F16C 3/14

(52) U.S. Cl. ..... 184/1.5; 222/386.5; 222/389

(58) Field of Search ..... 137/564.5; 222/386.5, 222/389; 184/1.5

(56) References Cited

U.S. PATENT DOCUMENTS

| | | | | |
|---|---|---|---|---|
| 195,126 A | * | 9/1877 | Hersey | 222/389 |
| 505,073 A | * | 9/1893 | Van Fleet | 222/389 |
| 549,479 A | * | 11/1895 | Hall | 137/564.5 |
| 637,250 A | | 11/1899 | Hall | 137/564.5 |
| 1,493,049 A | | 5/1924 | Mitchell | 184/39 |
| 1,630,899 A | | 5/1927 | Lynch | 184/39 |
| 2,529,937 A | | 11/1950 | Hale | 222/386.5 |
| 2,766,907 A | | 10/1956 | Wallace, Jr. | 222/386.5 |
| 3,033,311 A | | 5/1962 | Edgar et al. | 184/1.5 |
| 3,112,845 A | | 12/1963 | Bryant | 222/129 |
| 3,223,291 A | | 12/1965 | Thomas | 222/249 |
| 3,236,268 A | | 2/1966 | Simpson | 141/27 |
| 3,370,759 A | | 2/1968 | Johansson | 222/249 |
| 3,513,941 A | | 5/1970 | Becnel | 184/1.5 |
| 3,565,287 A | | 2/1971 | Johnston | 222/26 |
| 4,120,425 A | | 10/1978 | Bethurum | 222/146 C |
| 4,193,487 A | | 3/1980 | Takeuchi | 194/9 T |
| 4,438,872 A | | 3/1984 | Dooley et al. | 222/217 |
| 4,635,848 A | | 1/1987 | Little | 137/564.5 |
| 4,745,989 A | | 5/1988 | DiMatteo | 184/1.5 |
| 4,804,065 A | | 2/1989 | Scragg | 184/39 |
| 4,869,346 A | | 9/1989 | Nelson | 184/1.5 |
| 5,044,334 A | | 9/1991 | Bedi | 123/196 R |
| 5,094,269 A | | 3/1992 | Agulia | 137/564.5 |
| 5,130,014 A | | 7/1992 | Volz | 210/130 |

(List continued on next page.)

FOREIGN PATENT DOCUMENTS

| | | | |
|---|---|---|---|
| DE | 1023597 | 1/1958 | 137/564.5 |

OTHER PUBLICATIONS

Selby, U.S. Prov'l Appl. Ser. No. 60/092,127 filed Jul. 9, 1998.

Selby, U.S. Prov'l Appl. Ser. No. 60/132,087 filed Apr. 30, 1999.

*Primary Examiner*—Gerald A. Michalsky
(74) *Attorney, Agent, or Firm*—Christopher John Rudy

(57) ABSTRACT

Device for precise replacement of liquid has boundaries for one incoming liquid or more and one exiting liquid or more, and one pressure-transmitting barrier or more. The device may be augmented by a makeup contrivance or be for makeup alone. The device can include or be provided with one or more of the following: multiple units of the device; delivery of multiple, separate liquids; various rates of replacement; topping up of expended liquids and/or their additives; use of vacuum force from operation of the mechanism to induce replacement; and/or use of pneumatic, hydraulic and/or mechanical actuated force to induce replacement. Examples of pressure-transmitting barriers are a simple piston; a multi-part, expansible piston; one diaphragm or more; one flexible bag or more; and combinations thereof. Liquid can be replaced during normal operation of the mechanism.

22 Claims, 5 Drawing Sheets

U.S. PATENT DOCUMENTS

| | | | | |
|---|---|---|---|---|
| 5,190,120 | A | | 3/1993 | Watts ..... 184/1.5 |
| 5,238,085 | A | | 8/1993 | Engelmann ..... 184/1.5 |
| 5,263,445 | A | | 11/1993 | Bedi et al. ..... 123/196.005 |
| 5,284,223 | A | | 2/1994 | Fisher ..... 184/6.4 |
| 5,289,898 | A | | 3/1994 | Oberg ..... 184/1.5 |
| 5,318,080 | A | | 6/1994 | Viken ..... 141/98 |
| 5,361,870 | A | | 11/1994 | Courcy ..... 184/1.5 |
| 5,362,642 | A | | 11/1994 | Kern ..... 435/240 |
| 5,372,219 | A | | 12/1994 | Peralta ..... 184/1.5 |
| 5,398,851 | A | | 3/1995 | Sancoff et al. ..... 222/386.5 |
| 5,423,399 | A | | 6/1995 | Smith et al. ..... 184/7.4 |
| 5,505,708 | A | | 4/1996 | Atkinson ..... 604/140 |
| 5,522,474 | A | | 6/1996 | Burman ..... 184/1.5 |
| 5,667,037 | A | | 9/1997 | Orlitzky ..... 184/39 |
| 5,871,068 | A | | 2/1999 | Selby ..... 184/1.5 |
| 6,019,196 | A | * | 2/2000 | Selby et al. ..... 222/386.5 X |

* cited by examiner

PRECISE REPLACEMENT OF LIQUIDS AND COMPONENTS IN A LIQUID MIXTURE

CROSS-REFERENCES

Priority under 35 USC 119(e) is claimed of U.S. application numbers 60/092,127 filed on Jul. 9, 1998 and 60/132,087 filed on Apr. 30, 1999. The complete specifications of those provisional patent applications are incorporated herein by reference.

FIELD

In general, the present invention concerns a device and method for precise replacement of liquid, or a component in a liquid mixture, before, during or after operation of a mechanism, including where the volume of an incoming liquid displaces and delivers an exact replacement ratio or volume of outgoing liquid, which may be augmented by a makeup volume of liquid that may be delivered without regard to an incoming liquid. The invention, as may be appropriate, can particularly concern multiple units of the device; delivery of multiple, separate liquids; various rates of replacement; topping up of expended liquids and/or their additives; use of vacuum force from operation of the mechanism to induce replacement; and/or use of pneumatic and/or mechanical actuated force to induce replacement.

BACKGROUND

Selby, in U.S. Pat. No. 5,871,068, discloses a device for precise replacements of liquids, before, during, or after operation of a mechanism with method of use thereof. Selby et al., in U.S. patent application Ser. No. 08/980,005, now U.S. Pat. No. 6,019,196, discloses a bag-containing device for precise replacement of liquid before, during, or after operation of a mechanism, and method of its use. The specifications of the Selby '068 patent and Selby et al. '005 utility patent application are incorporated herein by reference.

In general, a problem in the art is that internal combustion engines, automatic transmissions, and other mechanisms may lose oil, automatic transmission fluid, or other liquid lubricant. This volume of lubricant lost is not accounted for by the aforementioned precise replacement devices and methods.

It would be desirable to overcome or ameliorate this problem.

SUMMARY

The instant invention provides a device for precise replacement of liquid, which may be augmented by makeup or be for makeup alone, in general, which device can comprise boundaries for at least one incoming liquid volume and at least one exiting liquid volume, and between or among the incoming and exiting liquid volumes at least one pressure-transmitting barrier. The makeup augmentation can comprise a contrivance for expelling a liquid not regulated by an incoming liquid. Multiple units of the device; delivery of multiple, separate liquids; various rates of replacement; topping up of expended liquids and/or their additives; use of vacuum force from operation of the mechanism to induce replacement; and/or use of pneumatic, hydraulic and/or mechanical actuated force to induce replacement, can be provided as or in conjunction with the device. The invention provides further for a method for precise replacement with optional makeup of a liquid in a mechanism by operation of the device, which may occur before, during or after operation of the mechanism.

The invention is useful in replacement and/or maintenance of fluids, especially liquid lubricants, in mechanisms. Thus, the invention is useful in liquid-handling and more poignantly in lubrication of the mechanism.

Significantly hereby, liquid lubricants not only can be replaced and/or components thereof added with precision based upon intake of used liquid but also can be augmented to make up for any loss thereof. Notably, this can be provided for or occur during normal operation of the mechanism, for example, during the driving of a motor vehicle. As well, this goes along with the fact that lubricants and other fluids used in various mechanisms are seldom provided without some beneficial additives. Following upon this, for one thing, the present invention amplifies the contributions made by these additives by making it possible to inject more than that which would otherwise be present in the normal replacement fluid, thus increasing oxidation resistance, antiwear behavior, and so forth. Moreover, since the exact incremental replacement of a well used oil may only provide the level of additive content of a new oil, is is advantageous to use the replacing fluid to add higher levels of particular additives to upgrade the used oil even further. Beneficially thus, mechanisms such as internal combustion engines, automatic transmissions, gear boxes, and so forth can have their critical lubrication fluids intermittently if not constantly maintained or improved so as to engender longer service lives for the lubricating fluids and in turn the mechanisms.

Numerous further advantages attend the invention.

DRAWINGS

The drawings form part of the specification hereof. With respect to the drawings, in addition to those and that which is written about those from the aforesaid patent to Selby and application of Selby et al., the following is briefly noted:

Figure 5:
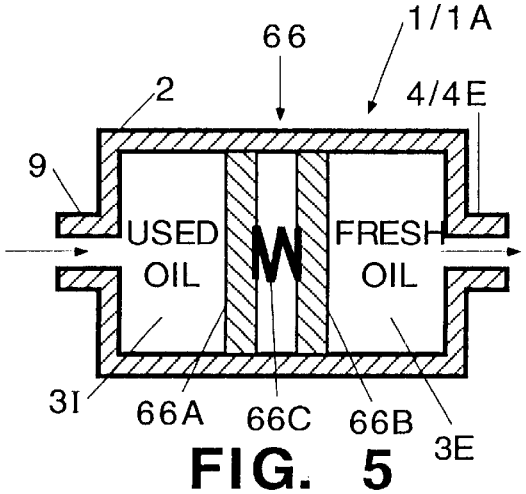
FIG. 5 is side, sectional view of yet another embodiment of a device of the instant invention, which has a splittable piston as a pressure-trasmitting barrier, and which also can be employed to provide precise replacement with makeup of a liquid.
Figure 5A:
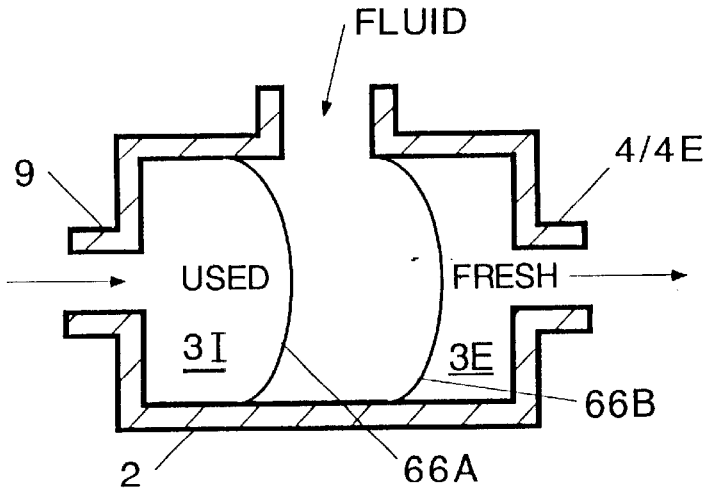
Figure 5B:
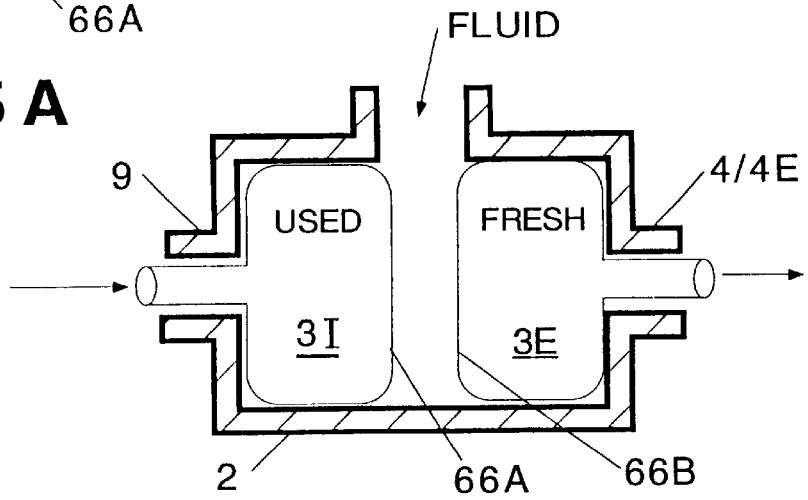
Figure 5C:
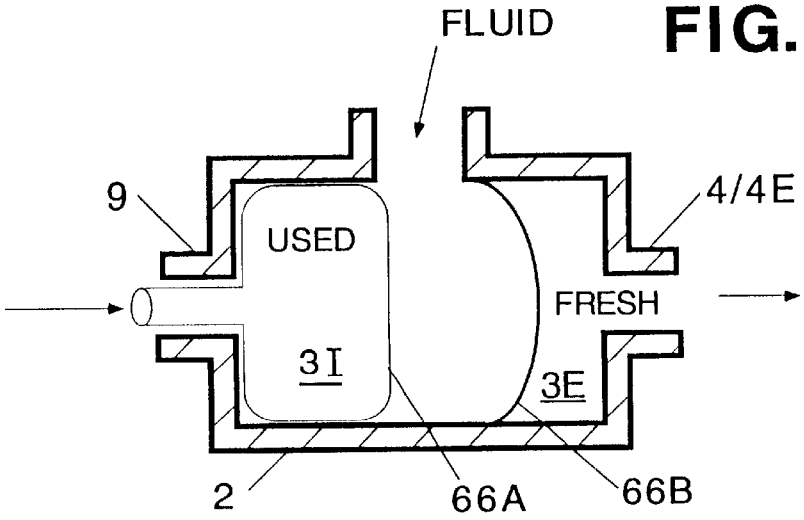

In FIGS. 5A, 5B & 5C are shown embodiments of such a device with multi-part pressure-transmitting barriers of diaphragms (A), flexible bags (B), and a diaphragm plus a flexible bag (C).

Figure 6:
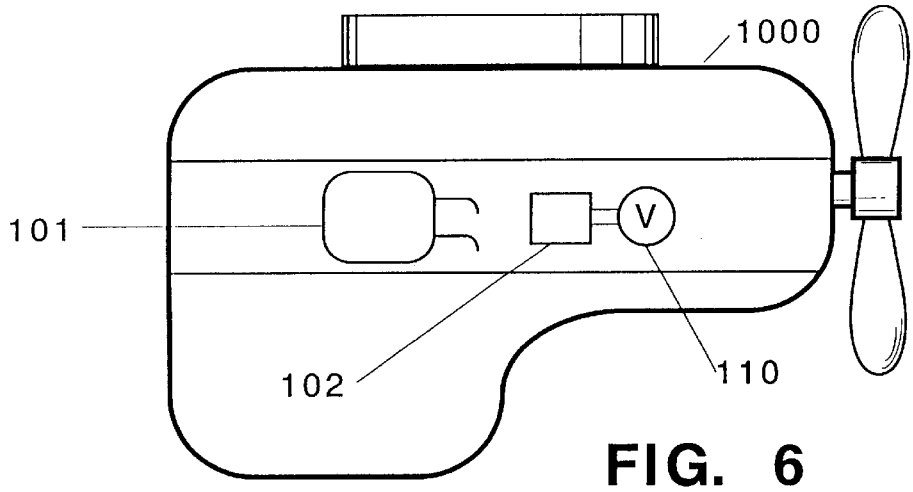

FIG. 6 is a side view of a device of the invention having multiple device units, each capable of delivering a liquid to the mechanism to which it is connected.

Figure 7A:
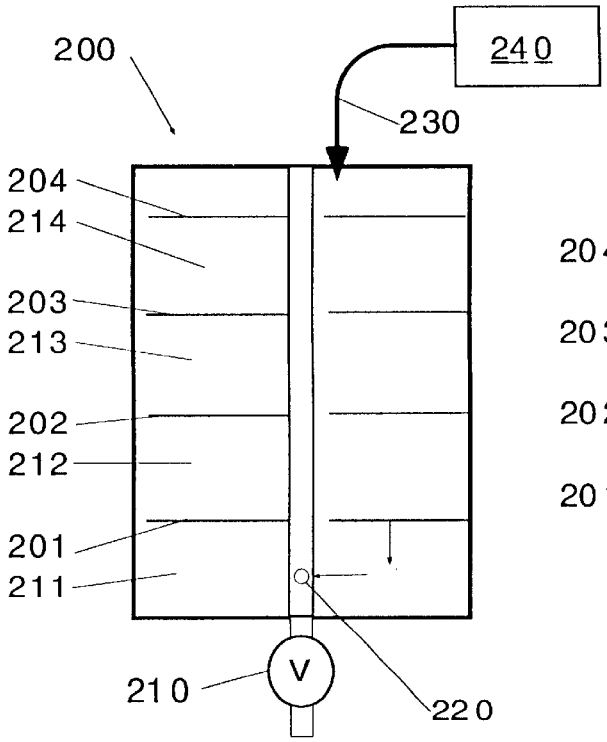
Figure 7B:
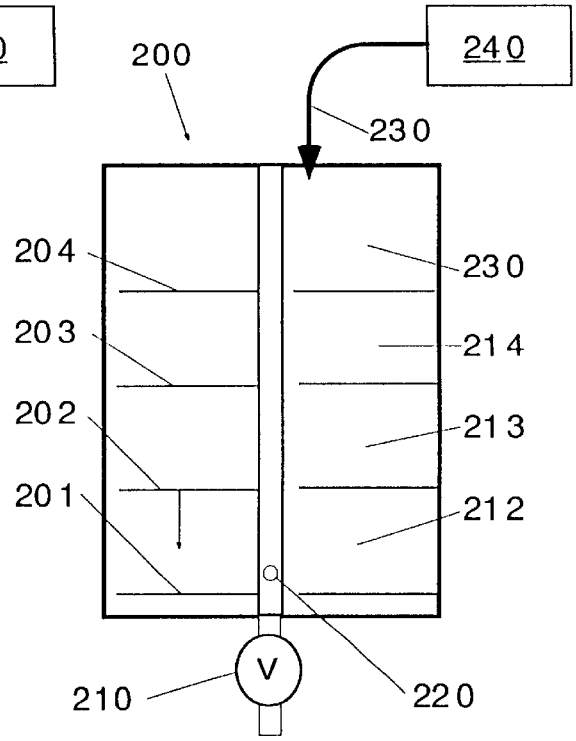
Figure 7C:
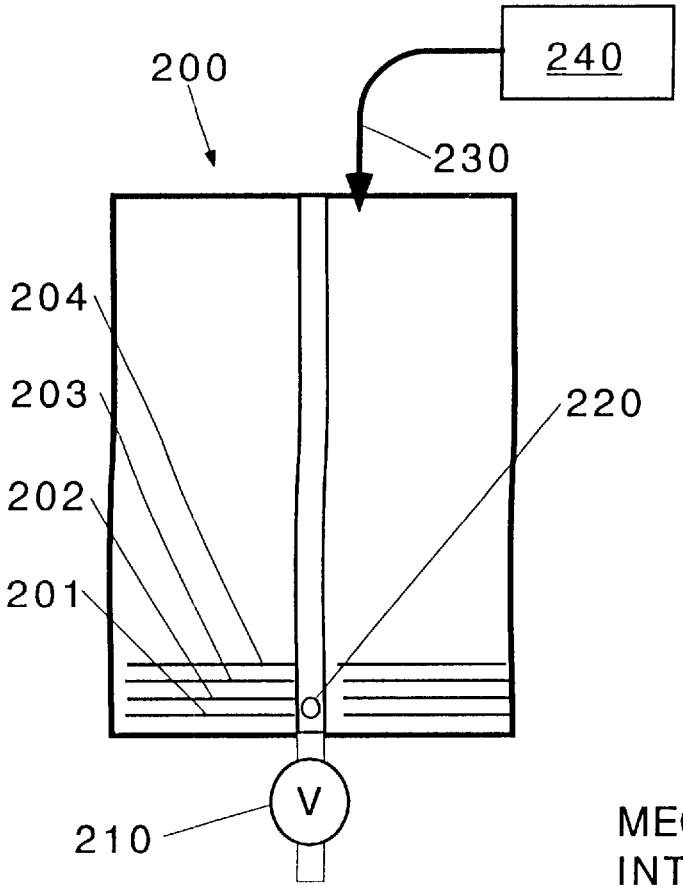

FIGS. 7A, 7B & 7C are side plan views of an embodiment of the invention having multiple, sequential liquid delivery capability in an initial phase of delivery (7A); an intermediate phase of delivery (7B); and a final phase of delivery (7C).

Figure 8:
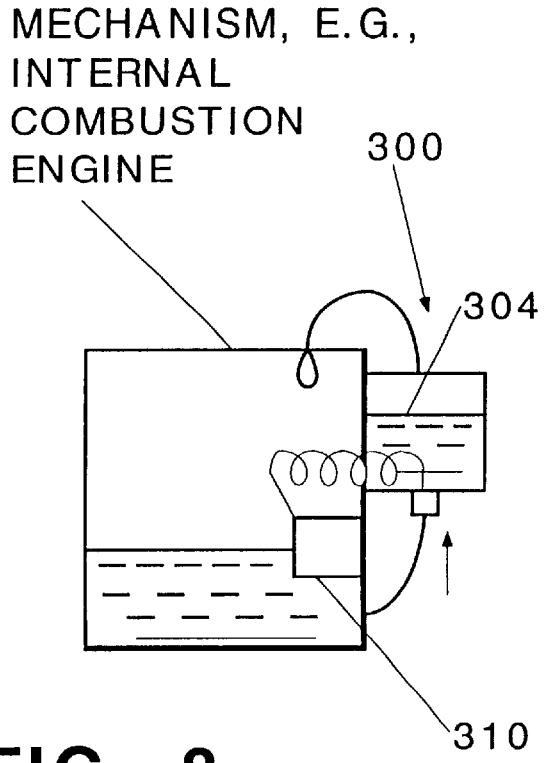

FIG. 8 is a side plan view of an embodiment of the invention which can provide a rate of replacement to the mechanism to which it is connected, the rate being other than 1:1.

Figure 9:
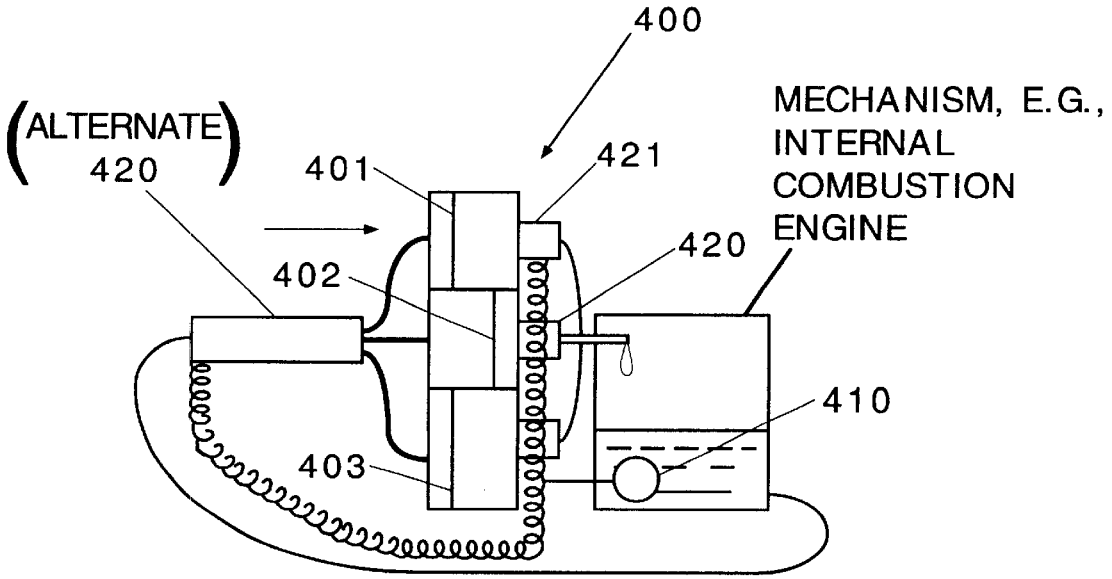

FIG. 9 is a side plan view of an embodiment of the invention which can provide for topping up of expended liquids and/or their additives for the mechanism to which it is connected.

Figure 10:
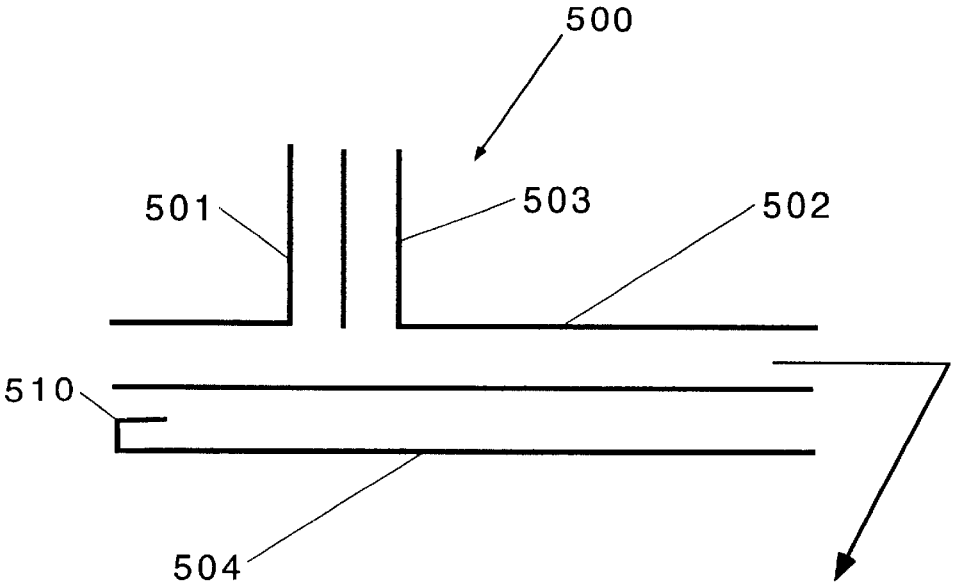

FIG. 10 is a side plan view of an embodiment of the invention which employs vacuum from operation of the mechanism to induce the liquid replacement to the mechanism.

ILLUSTRATIVE DETAIL

The invention can be further understood by the instant detail, which may be read in view of the drawings. Such is to be taken in an illustrative and not necessarily limiting sense.

The instant invention may be considered an improvement upon the devices and methods disclosed in the aforesaid patent to Selby and application to Selby et al. Features, subcombinations, combinations and principles thereof may be applied hereto. For example, the pressure-transmitting barrier, in general, may be taken to be a piston or diaphragm, and further, the diaphragm may be provided by one flexible bag or a plurality of flexible bags. Boundaries for the liquids may be provided by a housing within which may be at least one pressure-transmitting barrier or, say, by a bag, which may be a bag within a bag system. In general, the device of the invention can employ at least one device as found in the aforementioned disclosures of Selby and Selby et al. Combinations of pressure-transmitting barriers may be employed. And so, for example, one or more of those piston-, diaphragm- and/or bag-containing device(s) for precise replacement of liquids before, during or after operation of a mechanism is(are) employed and/or modified to suit the intents and purposes hereof.

In general, with respect to the drawings and in particular with respect to FIGS. 1–5, device 1 for precise replacement of liquid, which may be augmented by make up contrivance 1A, may have housing 2 but includes at least one exiting liquid volume 3E and at least one incoming liquid volume 3I, and between or among the exiting and incoming liquid volumes 3E, 3I, at least one pressure-transmitting barrier 6, 66, which may be termed an inter-volume pressure-transmitting barrier. The makeup augmentation contrivance 1A may expel a liquid unrelated to, i.e., independent of, any incoming liquid; in other words, an incoming liquid from the mechanism may not be required to expel the liquid from the makeup augmentation contrivance 1A. Thus, a separate pump or other liquid-forcing unit may be employed to deliver a makeup volume of fresh liquid from the contrivance 1A. The device 1 includes liquid exit orifice 4 and liquid entrance orifice 9, and the contrivance 1A can include fluid substance entrance orifice 9A (although a fluid substance may not be required to expel exiting liquid 3E) and liquid exit orifice 4E. Valves may be employed to help regulate flow.

Figure 1:
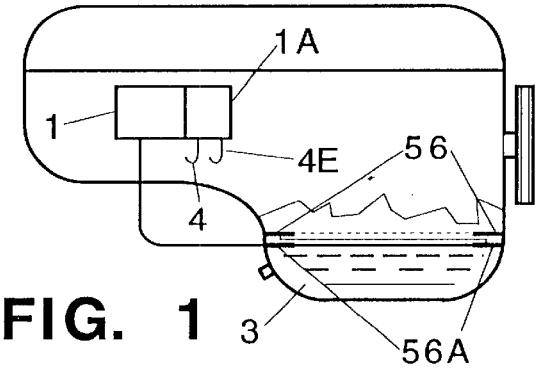
FIG. 1 is a side, partially cut away view of an embodiment of the instant invention, a device for precise replacement with makeup augmentation connected with a mechanism, which here is for maintenance of lubricating oil in an internal combustion engine.

More particularly, in FIG. 1, an internal combustion engine is seen equipped and in communication with the device for precise replacement with makeup 1/1A. In addition to features such as indicated above, upper sensor set 56 may be provided the engine to communicate to the makeup contrivance 1A that oil in the oil pan of the engine is at the full level, and thus to indicate to the contrivance 1A to stop inputting lubricating oil to the engine through the exit orifice or line 4E. By providing the sensor set 56 in tandem at a height at which the lubricating oil reservoir is full while the engine is level with respect to the force of gravity, and with both sensors required to indicate to the contrivance 1A to stop the input of oil to the engine, the engine oil reservoir does not become overfilled with oil such as may otherwise occur when oil would be added on an incline with employment of only one sensor 56. As an alternative, however, and this may be advantageously employed, one sensor 56 may be effectively employed in conjunction with a leveling sensor or inclinometer (not illustrated) to indicate that the engine is level and the solitary sensor 56 is sensing liquid level appropriate to that orientation. In the lattermentioned alternative, when the engine is not level, oil is not pumped into the crankcase. Auxiliary, lower sensor set 56A may be provided to indicate to the contrivance 1A that oil in the oil reservoir has reached to lower threshold volume and trigger the input of makeup oil to the engine; in this system, when the level of the oil in the reservoir is between the sensors 56, 56A, oil is not added to the reservoir. Throughout the lifetime or a part of the lifetime of the engine, a supply of fresh oil and/or oil additive(s) can be supplied to the engine through the exit orifice or line 4 controlled by a supply of used oil taken from the oil reservoir of the engine which enters the device 1 through the entry orifice or line 9, say, having been drawn by action of a precisely calibrated pump (not illustrated); this may be all controlled by an on-board computer. Thus, not only can any lost oil be made up but also by freshening up the supply of oil in the reservoir of the engine with suitably graded motor oil, motor oil enriched in certain additives determined to have been depleted in the supply of oil in the engine, for example, through heat and shear degradation, and/or a supply of the additives themselves, the engine oil may "stay-in-grade" for a longer duration in spite of the commonly encountered degradation of the working motor oil.

Figure 2:
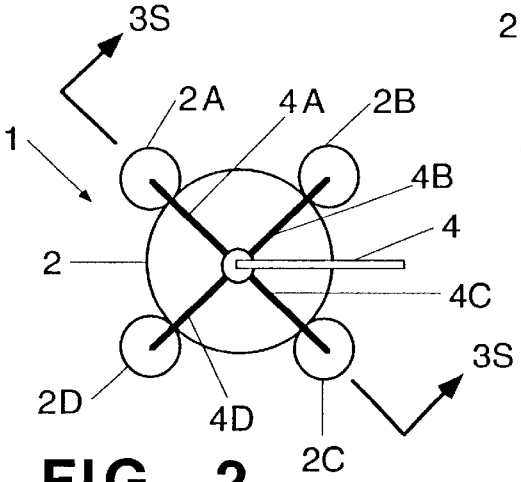
FIG. 2 is a top view of another embodiment of a device of the instant invention, which has a main housing and four auxiliary housings for precise replacement of liquid(s).
Figure 3:
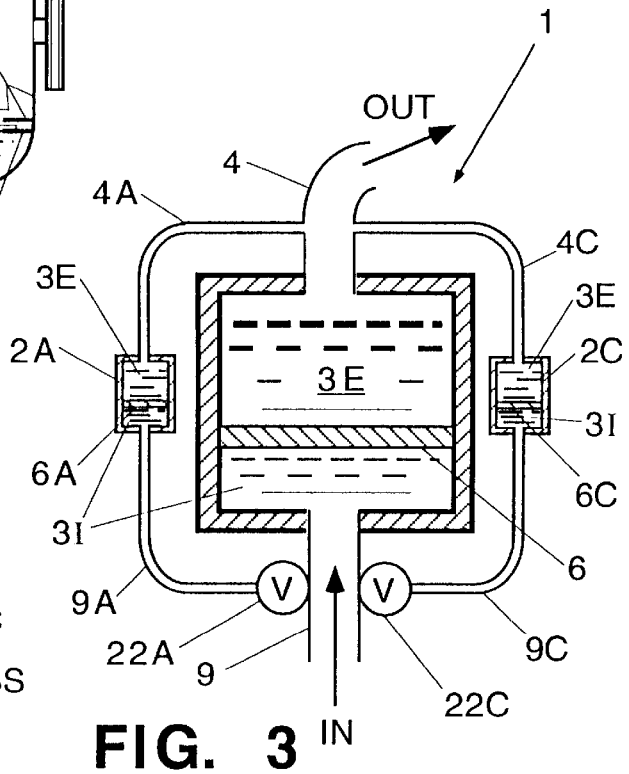
FIG. 3 is a sectional view of the device of FIG. 2, taken along 3s—3s.

In FIGS. 2 & 3, device for precise replacement with makeup augmentation 1 has main housing 2 and four auxiliary housings 2A, 2B, 2C, 2D for precise replacement of up to five different liquid samples. Again in addition to features such as indicated above, the device 1 also includes with respect to each housing 2, 2A, 2B, 2C, 2D, exit orifice or line 4, 4A, 4B, 4C, 4D; pressure-transmitting barrier, for example, piston 6, 6A, 6C, and liquid entry orifice or line 9, 9A, 9C, as illustrated in FIG. 3 (other pressure-transmitting barriers and liquid entry orifices or lines not illustrated). Valves such as the valves 22A, 22C may be provided and employed to regulate transfer of the particular fresh liquid sample 3E from the device, which may be accomplished through computer and/or manual control. Regulation, in addition to the presence of the valves, which regulate by controlling the amount of fluid entering and hence leaving a housing, among other ways, may be provided through the sizes or diameters of pistons or other pressure-transmitting barriers, and orifice sizes.

Figure 4:
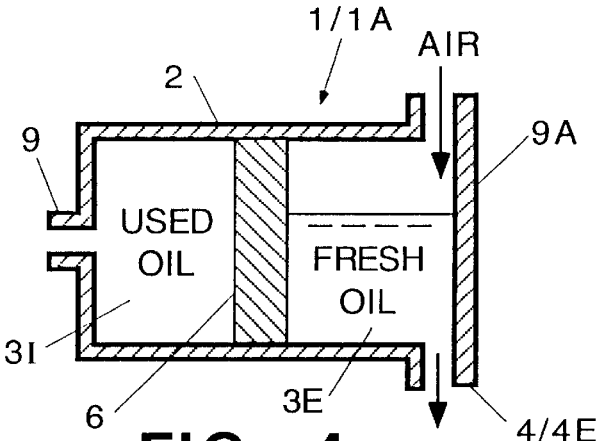
FIG. 4 is a side, sectional view of another embodiment of a device of the instant invention, which can be employed to provide precise replacement with makeup of a liquid.

In FIG. 4, device for precise replacement with makeup 1/1A has, in addition to features such as indicated above, a separate fluid substance entry port 9A, through which a fluid substance, for example, air, may be passed to force out liquid 3E through the exit port 4/4E. A bladder (not illustrated) may be employed to confine the fluid substance and act as another separate pressure-transmitting barrier. The operation of the makeup function from the fluid substance entering through the orifice 9A may be carried out separately from or in addition to the precise replacement function of the device through liquid pressure on the pressure-transmitting barrier 6, for example, a piston as shown.

In FIG. 5, device for precise replacement with makeup 1/1A has, in addition to features such as indicated above, multi-part piston 66. Under precise replacement conditions the two pistons 66A, 66B act in direct concert, and the amount of used oil or other incoming liquid 3I which enters the orifice 9 is the same amount of fresh oil or other exiting liquid 3I which leaves the orifice 4/4E. Under makeup conditions, however, piston-expanding unit 66C such as by motor-driven screw or scissors, electricity- or heat-activated expansion material, or pneumatic or hydraulic flow between the pistons 66A, 66B pushes the second piston 66B away from the first piston 66A, which, owing to incompressibility of the used liquid 3I and open communication of the orifice 4/4E with the lubricating liquid supply of the mechanism, forces fresh lubricating liquid 3E out the orifice 4/4E and into the mechanism. The unit 66C may be provided by a single spring or by a staged group of springs, where the spring is released to effect pushing of the second piston 66B either all at once or in increments with the assistance of a spring-stopping contrivance or where the group of springs is activated to release one spring at a time with each spring released extending further and further or once again in increments. Diaphragms and/or bags may be used with or substituted for the pistons 66A, 66B, especially when these alternative pressure-transmitting barriers are pushed apart by fluid pressure, pneumatic (gas) and/or hydraulic (liquid). See, FIGS. 5A, 5B & 5C.

As in FIGS. 1, 3–5, 5A, 5B & 5C oil is an exemplary liquid 3, 3E, 3I.

Furthermore, in FIG. 6 is depicted device 100 having multiple device units 101, 102. Each of the units 101, 102 can deliver a liquid to the mechanism, for example, automobile engine 1000, to which it is connected. For example, the unit 101, which has a piston to deliver the liquid, can deliver standard motor oil; and the unit 102, which contains a disposable bag holding liquid for delivery, can deliver motor oil additives upon the triggering of a certain mileage since the last oil change such as by electronic and/or physical properties and/or chemical monitoring or even by manual activation such as by throwing a release switch which opens valve 110 so that the additives can be delivered, for example, by vacuum assistance. Note, FIG. 10.

In FIGS. 7A, 7B & 7C are depicted stages of device 200 having multiple sequential liquid delivery capability. The device 200 includes four pistons 201, 202, 203, 204 which separate four liquid sample chambers 211, 212, 213, 214, each of which chambers can hold the same liquid or differing liquids, for example, motor oil(s). Exit hole 220 accommodates exit of the liquids and their delivery in proper sequence. In an initial phase (FIG. 7A) each of the chambers 211, 212, 213, 214 is full of the liquid, ready for delivery through pressure applied to the fourth piston 204 from entry of used liquid to be replaced from and in the operating mechanism into the housing which holds the pistons and contains the liquids of interest; in an intermediate phase (FIG. 7B) the first piston 201 has been forced to the end of its travel from the pressure of the used liquid 230, and the first liquid sample has been fully delivered, with the liquid sample in chamber 212 being delivered; in a final phase (FIG. 7C) all four pistons 201, 202, 203, 204 lie at the end of their travel, and all of the four liquid samples have been sequentially delivered. As an example of how this may be employed, initially chambers 211, 212 & 213 can contain SAE 10W40 motor oil, say, for delivery during spring, summer and autumn, respectively, and the chamber 214 can contain 5W30 motor oil, say, for delivery during winter. The liquid in a chamber may be incited to be delivered upon the triggering of a certain mileage since the last oil change such as by electronic, physical properties and/or chemical monitoring or by manual activation such as by throwing a release switch which opens valve 210 such as described above and/or operates pump 240 so that the additives can be delivered in such a manner.

In FIG. 8 is depicted device 300, which can provide a rate of liquid replacement to the mechanism to which it is connected, the rate being other than 1:1. In the device 300 are found piston or diaphragm 304, which may be provided by a bag, and sensor 310 which indicates that the operating fluid in the mechanism to be replaced is being lost from the mechanism by leakage or other path of loss. This sensor 310 increases the rate of replacement to more than a 1:1 ratio to make up for the operating fluid loss from the mechanism. In some cases, dilution of the fluid in the mechanism to be replaced increases its volume, and the sensor 310 increases the rate of withdrawal of the operating fluid to keep the working level at the optimum volume. For example, an automotive engine oil may leak out the engine or be lost to the combustion process by leakage past the piston rings. In such a case, the sensor 310 will increase the rate of replacement to a withdrawal to a value somewhat greater than 1:1, thus assuring that the working level of oil in the engine is always at the desired volume. In a similar manner, short trip driving where the engine never warms up sufficiently may cause fuel dilution of the engine oil. In this case, the sensor 310 will cause the rate of withdrawal to be greater than the rate of replacement, again assuring that the working level of oil in the engine is always at the desired volume.

In FIG. 9 is shown device 400, which can provide for topping up of expended liquids and/or their additives for the mechanism to which it is connected. In the device 400 are found separate compartments or sectors with pistons or diaphragms 401, 402, 403, respectively, which may be provided by bags, and sensor 410 that can determine the additive or expended additive level of a fluid. By use of activated valving 420 controlling which sector of the device 400 is open, preferential additives may be injected into the working fluid. For example, an engine oil may have properties detected by the sensor 410 that reveal that the oxidation inhibitor of the oil is becoming insufficient to handle the proper operation and resistance to deposits as would otherwise be desired in the engine. The sensor 410 sends a signal, which in turn closes all valves 420 except the valve 421 permitting oxidation inhibitor to flow into the operating engine oil. Thus, the engine is kept in its best operating condition; its life is extended, and its emissions (which are otherwise increased by deposits in certain locations) are kept in check.

In FIG. 10 is shown an embodiment of the invention, which employs vacuum from operation of the mechanism to induce liquid replacement to the mechanism. Device 500 has vacuum-assist coupling 501. For an example, the device 500 can be connected to the intake manifold of an internal combustion engine with the coupling 501 communicating through arm 502 with the inside of the manifold. When the engine is running, vacuum from the manifold is provided the arm 502, and the liquid, for example, a motor oil additive, is drawn from the device 500 through arm 503. Arm 504 can be connected to sensor 510 which serves to determine when enough additive has reached the operating engine oil, and which serves to temper the vacuum.

The device 1/1A, 100, 200, 300, 400, 500 is of the invention.

In addition, in general, any combination of fluids or additives can be selected for the operating fluid replacement process. Some additives are expended more rapidly than others in certain devices and forms of operation. Thus, the ability to modify the response of the replacement device is very helpful.

CONCLUSION

The present invention is thus provided. Various features, subcombinations and combinations may be effected with or without reference to other features, subcombinations or combinations in the practice of the invention, and numerous adaptations and modifications can be effected within its spirit, the literal claim scope of which is particularly pointed out as follows:

I claim:

1. A device for precise replacement of liquid in a mechanism, to be at least one of being augmented by makeup and being for makeup alone, in general, which device comprises boundaries for at least one incoming liquid volume and at least one exiting liquid volume, and, one of between and among the incoming and exiting liquid volumes, at least one pressure-transmitting barrier, wherein the device includes at least one of the following: multiple units of the device; delivery of multiple, separate liquids; various rates of replacement, in which is provided a rate of replacement of total volume of incoming liquid to total volume of exiting liquid that is other than 1:1; topping up of at least one of expended liquids and their additives; use of vacuum force from operation of the mechanism to induce replacement; and use of at least one of pneumatic, hydraulic and mechanical actuated force to induce replacement, in which force provided by the at least one of pneumatic, hydraulic and mechanical actuated force to induce replacement is provided by at least one of being in lieu of force provided by incoming liquid and in addition to force provided by incoming liquid—with the provisos that when only one incoming liquid volume and one exiting liquid volume are present and the at least one pressure-transmitting barrier is made up of two pistons, the two pistons are movable relative one another; that when only one incoming liquid volume and one exiting liquid volume are present and the at least one pressure-transmitting barrier is made up of two diaphragms, the two diaphragms are movable relative one another; that when multiple outlets are present, the rate of replacement of total volume of incoming liquid to total volume of exiting liquid is other than 1:1; that, when said multiple units of the device are present, at least one of the following are also present: said delivery of multiple, separate liquids; said various rates of replacement; said topping up; said use of vacuum force from operation of the mechanism to induce replacement; and said use of at least one of pneumatic, hydraulic and mechanical actuated force to induce replacement; and that when said use of hydraulic actuated force to induce replacement is included, the device further comprises, in combination, the mechanism, and the liquid is a lubricant.

2. The device of claim 1, wherein a plurality of pressure-transmitting barriers are present to provide for multiple sequential liquid delivery capability.

3. The device of claim 2, wherein said plurality of pressure-transmitting barriers are composed of stackable pistons.

4. The device of claim 1, wherein rate of replacement is other than 1:1.

5. The device of claim 1, wherein use of vacuum force from operation of the mechanism induces replacement.

6. A device for precise replacement of liquid in a mechanism, to be at least one of being augmented by makeup and being for makeup alone, in general, which device comprises boundaries for at least one incoming liquid volume and at least one exiting liquid volume, and, one of between and among the incoming and exiting liquid volumes, at least one pressure-transmitting barrier, wherein the device includes at least one of the following: multiple units of the device; delivery of multiple, separate liquids; various rates of replacement; topping up of at least one of expended liquids and their additives; use of vacuum force from operation of the mechanism to induce replacement; and use of at least one of pneumatic, hydraulic and mechanical actuated force to induce replacement—with the provisos that when only one incoming liquid volume and one exiting liquid volume are present and the at least one pressure-transmitting barrier is made up of two pistons, the two pistons are movable relative one another; and that when only one incoming liquid volume and one exiting liquid volume are present and the at least one pressure-transmitting barrier is made up of two diaphragms, the two diaphragms are movable relative one another—wherein the makeup augmentation includes not only a device with means for precise replacement where expelled liquid is regulated by incoming liquid but also a contrivance with means for expelling liquid not regulated by incoming liquid.

7. The device of claim 6, wherein multiple device units for precise replacement of a liquid are present.

8. The device of claim 6, wherein a multi-part pressure-transmitting barrier is present.

9. The device of claim 8, wherein said pressure-transmitting barrier is at least one of a multi-unit diaphragm set; a multi-unit flexible bag set; and a multi-unit diaphragm and flexible bag set.

10. The device of claim 8, wherein said pressure-transmitting barrier is a multi-part piston.

11. The device of claim 6, wherein use of vacuum force from operation of the mechanism induces displacement.

12. A device for precise replacement of liquid in a mechanism, to be at least one of being augmented by makeup and being for makeup alone, in general, which device comprises boundaries for at least one incoming liquid volume and at least one exiting liquid volume, and, one of between and among the incoming and exiting liquid volumes, at least one pressure-transmitting barrier, wherein the device includes at least one of the following: delivery of multiple, separate liquids; various rates of replacement, in which is provided a rate of replacement of total volume of incoming liquid to total volume of exiting liquid that is other than 1:1; topping up of at least one of expended liquids and their additives; use of vacuum force from operation of the mechanism to induce replacement; and use of at least one of pneumatic and mechanical actuated force to induce replacement, in which force provided by the at least one of pneumatic and mechanical actuated force to induce replacement is provided by at least one of being in lieu of force provided by incoming liquid and in addition to force provided by incoming liquid—with the provisos that when only one incoming liquid volume and one exiting liquid volume are present and the at least one pressure-transmitting barrier is made up of two pistons, the two pistons are movable relative one another; that when only one incoming liquid volume and one exiting liquid volume are present and the at least one pressure-transmitting barrier is made up of two diaphragms, the two diaphragms are movable relative one another; and that when multiple outlets are present, the rate of replacement of total volume of incoming liquid to total volume of exiting liquid is other than 1:1.

13. The device of claim 12, wherein the makeup augmentation includes not only a device with means for precise replacement where expelled liquid is regulated by incoming liquid but also a contrivance with means for expelling liquid not regulated by incoming liquid.

14. The device of claim 13, wherein a multi-part pressure-transmitting barrier is present.

15. The device of claim 14, wherein said pressure-transmitting barrier is at least one of a plurality of diaphragms; a plurality of flexible bags; and a set of at least one diaphragm and at least one flexible bag.

16. The device of claim 14, wherein said pressure-transmitting barrier is a multi-part piston.

17. The device of claim 13, wherein the rate of replacement is other than 1:1.

18. The device of claim 13, wherein use of vacuum force from operation of the mechanism induces displacement.

19. The device of claim 14, wherein a plurality of pressure-transmitting barriers are present to provide for multiple sequential liquid delivery capability.

20. The device of claim 19, wherein said plurality of pressure-transmitting barriers are composed of stackable pistons.

21. The device of claim 14, wherein the rate of replacement is other than 1:1.

22. The device of claim 12, wherein use of vacuum force from operation of the mechanism induces displacement.

* * * * *